United States Patent [19]

Stio

[11] 4,240,548

[45] Dec. 23, 1980

[54] PUSH PACK

[76] Inventor: Joseph B. Stio, W. Lake Dr., Montauk, N.Y. 11954

[21] Appl. No.: 83,100

[22] Filed: Oct. 9, 1979

Related U.S. Application Data

[63] Continuation of Ser. No. 914,079, Jun. 9, 1978, abandoned.

[51] Int. Cl.[3] ..... B65H 85/10; B65D 5/32

[52] U.S. Cl. ..... 206/250; 206/268; 206/270; 229/11; 229/20

[58] Field of Search ..... 206/249, 250, 268, 270, 206/815; 229/11, 20

[56] References Cited

U.S. PATENT DOCUMENTS

| | | | |
|---|---|---|---|
| 311,641 | 2/1885 | Butler | 229/11 |
| 621,173 | 3/1899 | Stinton | 229/11 |
| 1,807,936 | 6/1931 | Saunders | 206/250 |
| 1,962,468 | 6/1934 | Stein | 229/20 |
| 2,265,828 | 12/1941 | Wilson | 206/268 X |
| 2,897,958 | 8/1959 | Tarleton et al. | 206/250 |
| 2,919,845 | 1/1960 | Hackmeyer | 229/20 X |
| 3,102,675 | 9/1963 | Schrom | 206/250 X |
| 3,105,591 | 10/1963 | Ahlbor | 206/268 X |
| 3,282,465 | 11/1966 | Davis | 206/250 X |
| 3,446,338 | 5/1969 | Bozyk | 206/250 |

FOREIGN PATENT DOCUMENTS

| | | | |
|---|---|---|---|
| 1013 | of 1870 | United Kingdom | 229/11 |

*Primary Examiner*—Stephen Marcus
*Attorney, Agent, or Firm*—Richard L. Miller

[57] ABSTRACT

A pack for containing cigarettes or other articles, and which includes a pivotable lid on an upper end of a carton which is opened or closed by a sliding sleeve around the outer side of the carton, the upper end of the sleeve being attached to the lid at a point that is a short distance away from the lid hinge on the carton, so to urge the lid to swing and allow dispensing the articles from the carton.

1 Claim, 6 Drawing Figures

10
14
12
13
Cigarettes
19
3
3
13
Cigarettes
12

33
32

11
13
12
34
19
11

12
10
13
27
25
35
20
19
30

13

23
17
18
30
22
26
24
15
16
28
20
21
35
25
12
13
31
29

PUSH PACK

This is a continuation, of application Ser. No. 914,079, filed June 9, 1978, now abandoned. This invention relates generally to dispensing cartons. More specifically, it relates to a cigarette pack.

A principal object of the present invention is to provide a dispensing carton, whereby a pivotable lid on top swings open when the bottom of the carton is upwardly pushed, in order that a content of the carton is able to be removed.

Another object is to provide a dispensing carton of disposable type, and which can be used for cigarettes, cigars, tobacco, band-aids or other household items.

Still another object is to provide a dispensing carton wherein the lid pivoting mechanism is quick operating to open or close, is foolproof and lasts the lifetime use of the carton.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims. FIG. 1 is a perspective view of a cigarette pack that incorporates the present invention, and shown prior to being opened up.

Figures 1, 2, 3, 4, 5, 6:
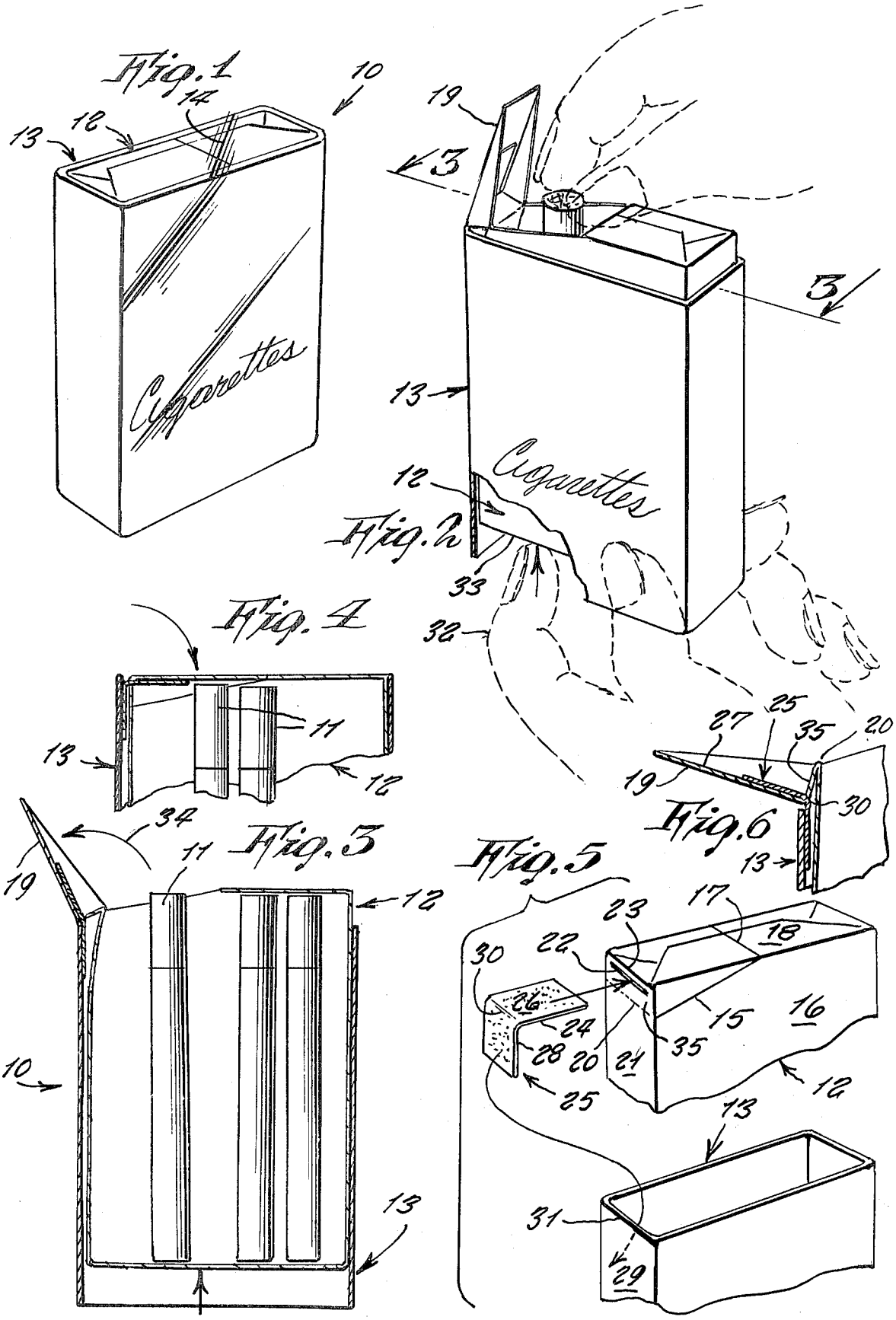
FIG. 2 is a similar view thereof with cellophane off and the pack opened, and the sleeve slid up to to flip open the lid.
FIG. 3 is a cross-section on line 3—3 of FIG. 2.
FIG. 4 is a similar view thereof, with lid flipped closed.
FIG. 5 is a detail of the construction of the invention.

FIG. 6 is a detail view similar to FIGS. 3 and 4, and illustrating the lid flipped fully open. Referring now to the drawing in greater detail, the reference numeral 10 represents a push pack according to the present invention, wherein the same is illustrated for use as a packet for containing the conventional number of twenty cigarettes 11. The packet icnludes a box or carton 12 made from bendable paper lined with foil on its inner side, and which is folded around the cigarette so to form the conventional rectangular shaped packet suitable for carrying in a purse or pocket of a smoker. In the present invention, the box or carton 12, thus formed is slid inside a sleeve 13. A cellophane film 14 is wrapped either around the caron alone or else around the entirely assembled carton with the sleeve, as shown.

The carton 12, after being folded as described above, and prior to being installed in the sleeve, is slitted at an upper corner, as shown in FIG. 5, with a diagonal slit 15 on opposite side walls 16 and an interconnecting slit 17 on a top wall 18 in order to form a lid 19 that is pivotable respective to a fold line 20 on end wall 21 and formed between the lower ends of the diagonal slits 15. A slit 22 is made precisely along an upper end edge 23 of the lid and one end half 24 of an adhesive tape 25 is inserted thereinto, so that an adhesive 26 of the tape is adhered to an underside of the lid top wall 27. The other end half 28 of the tape is then adhered to the inner side of the sleeve end wall 29. It is to be noted that the transverse fold line 30 across the tape is aligned precisely as close as possible to the top edge 31 of end wall 29 and also to the lid edge 23, so that the edges 31 and 23 are adjacent to each other, and about which the lid pivots in operative use.

In operative use, in order to dispense a cigarette, a person pushes a finger 32 against a bottom wall 33 of the carton so to cause it to slide up inside the sleeve. This causes the lid to pivot upward from a closed position as shown by arrow 34; the lid pivoting up about the tape fold line 30, due to the upward moving carton applying pressure against the lid short end wall 35 (formed between the edge 23 and the fold line 20) so as to cause the carton end wall 21 to buckle about the fold line 20, as shown in FIG. 3, and force the end wall 35 to pivot about the fold line 30, thus pivoting the lid to open position. As shown in FIGS. 3, 4 and 6, fold line 30 remains stationary and does not move upwardly above the top edge of the sleeve. Therefore, lid 19 does not slide with respect to sleeve 13, resulting in the above noted buckling of carton end wall 21. To close the lid, the carton is simply pushed down.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A push pack for cigarettes or the like, comprising in combination, a rectangular box-like carton made of folded, bendable paper around a quantity of enclosed cigarettes or the like, and a tubular sleeve in which said carton is slidable, said carton having an upwardly pivotable lid at one upper end corner thereof for access into said carton, and a mechanism for opening and closing said lid automatically when said carton is slid back and forth inside said sleeve, said lid being formed by an angular slit on each opposite side wall of said carton and an interconnecting slit across a top of said carton connecting upper ends of said angular slits, while a fold line spaced below the top edge lying transversely across an end wall of said carton intersects lower ends of said angular slits and forms a movable pivot for said lid; said lid accordingly comprising a top wall, an end wall at right angles thereto and opposite triangular side walls along side edges of said lid top, and pivot means comprising a tape with adhesive on one side, a transverse fold across said tape forming opposite end halves of said tape, said tape transverse fold being aligned adjacent to a corner of said lid formed between said lid top wall and said lid end wall, one of said tape end halves being adhered to an end wall of said sleeve, said tape transverse fold forming a stationary pivot located at the upper edge of said lid side wall, said pivot means acting as a hinge means for pivotally connecting the lid at the top edge of its end wall to the top edge of the sleeve end wall and for preventing sliding movement of the lid with respect to the sleeve, whereby upward sliding movement of the carton within the sleeve causes a buckling of the end wall of the carton whereby the movable pivot follows an arcuate path about said stationary pivot to thereby snap open said lid.

* * * * *